US006456004B1

(12) United States Patent
Johnson et al.

(10) Patent No.: US 6,456,004 B1
(45) Date of Patent: Sep. 24, 2002

(54) FLUORESCENT LAMP HAVING UNIQUELY CONFIGURED CONTAINER CONTAINING AMALGAM FOR REGULATING MERCURY VAPOR EQUILIBRIUM

(75) Inventors: Wayne D. Johnson, Chardon; Andrew P. Blau, Richmond Heights, both of OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/393,564

(22) Filed: Sep. 10, 1999

(51) Int. Cl.[7] ..... H01J 17/22; H01J 61/20

(52) U.S. Cl. ..... 313/552; 313/639; 313/490; 313/493; 313/564; 313/565

(58) Field of Search ..... 313/639, 490, 313/493, 550, 564, 565, 552

(56) References Cited

U.S. PATENT DOCUMENTS

| | | | | |
|---|---|---|---|---|
| 2,740,570 A | | 4/1956 | Breadner et al. | 226/19 |
| 3,224,651 A | | 12/1965 | Dayton et al. | 222/361 |
| 3,614,506 A | * | 10/1971 | Evans | 313/174 |
| 4,288,715 A | * | 9/1981 | van Overveld et al. | 206/6 |
| 5,274,305 A | * | 12/1993 | Bouchard | 315/108 |
| 5,294,867 A | * | 3/1994 | Grossman | 313/490 |
| 5,394,056 A | * | 2/1995 | Foreman et al. | 313/547 |
| 5,757,129 A | * | 5/1998 | Schafnitzel et al. | 313/565 |
| 5,828,169 A | | 10/1998 | Myojo et al. | 313/475 |
| 6,172,452 B1 | * | 1/2001 | Itaya et al. | 313/490 |
| 6,310,437 B1 | * | 10/2001 | Blau et al. | 313/490 |

FOREIGN PATENT DOCUMENTS

| | | | | |
|---|---|---|---|---|
| JP | 2001093466 | * | 4/2001 | H01J/61/28 |

* cited by examiner

*Primary Examiner*—Nimeshkumar D. Patel
*Assistant Examiner*—Sikha Roy
(74) *Attorney, Agent, or Firm*—Fay, Sharpe, Fagan, Minnich & McKee, LLP

(57) ABSTRACT

An apparatus and method for improving the performance of a lamp includes an envelope (10) enclosing an amalgam or dose (24) of mercury housed in a container (20). The container maintains mercury vapor equilibrium during lamp operation and prevents mercury diffusion during lamp off periods. The container has an opening (24) therein selectively adjustable between an open position and a closed position. A bimetal member (30) is associated with the opening of the container and provides the actuating means by which the container opens and closes. A stopping member (32), such as a valve or ball bearing, is attached to the bimetal member and extends into the container. When the lamp is in operation, the bimetal member is heated causing it to deflect. The deflection moves the stopping member from the container opening and enables the amalgam to maintain mercury vapor pressure equilibrium. When the lamp is turned off, the bimetal material contracts, closing the container and preventing diffusion of mercury into the amalgam. As a result, sufficient mercury vapor remains in the lamp envelope to provide peak lumen output upon lamp ignition.

16 Claims, 5 Drawing Sheets

FLUORESCENT LAMP HAVING UNIQUELY CONFIGURED CONTAINER CONTAINING AMALGAM FOR REGULATING MERCURY VAPOR EQUILIBRIUM

BACKGROUND OF THE INVENTION

1. Field of the Invention

This invention pertains to an apparatus and method for improving the performance of lamps by decreasing the amount of time it takes to reach full lumen output upon lamp starting. More particularly, the invention relates to a uniquely configured container disposed in a fluorescent lamp which maintains mercury vapor equilibrium during lamp operation and prevents mercury diffusion during lamp off periods.

2. Discussion of the Art

Maintaining mercury vapor pressure equilibrium within fluorescent lamps is necessary to maintain optimum lumen output during extended lamp on periods. In conventional fluorescent lamps the mercury vapor pressure increases to an optimum pressure allowing the lamp to reach maximum lumen output. As time passes, the mercury vapor pressure increases to a level above the most preferable pressure causing the luminous flux to decrease. Consequently, a need developed to regulate mercury vapor pressure in fluorescent lamps and thereby achieve peak lumen output for extended periods of time.

To remedy the foregoing situation, amalgams were introduced to maintain the mercury vapor pressure within an optimal range during lamp operation. Upon lamp ignition, the amalgam is heated which causes mercury to diffuse out of the solid and is released into the lamp as vapor. The amalgam achieves mercury vapor equilibrium during lamp operation by supplying the same amount of mercury atoms to the envelope as are spent. However, when the lamp is switched off, the decrease in temperature causes the mercury vapor to navigate to and diffuse into the amalgam causing mercury starvation. The lack of mercury vapor in the lamp envelope during lamp off periods results in low lumens at lamp startup. In order to obtain peak lumens upon lamp ignition without any start-up time penalty, an adequate dose of mercury vapor is required to remain in the lamp envelope during lamp off periods.

To date, no device exists which adequately prevents diffusion of mercury to the amalgam during lamp off periods so that sufficient vapor remains in the lamp atmosphere to provide lamp starting as if no amalgam were present. Continued modifications of the use of amalgams have afforded little success in maintaining sufficient vapor in the envelope when the lamp is turned off.

A recent attempt to remedy this situation is disclosed in U.S. Pat. No. 5,828,169. The amalgam is substantially enclosed by a barrier having an opening that restricts the return of mercury atoms to the amalgam during lamp off periods.

However, the lamp of U.S. Pat. No. 5,828,169 does not eliminate all mercury diffusion. After the lamp is turned off there is still access to the amalgam which allows diffusion of mercury. With extended off times, virtually all of the mercury can diffuse into amalgam. Therefore, the mercury vapor in the envelope decreases after the lamp is turned off thereby affecting the amount of time it takes to reach full lumen output upon lamp ignition.

Thus, a need exists to prevent mercury diffusion in fluorescent lamps so that sufficient mercury vapor remains in the lamp envelope during extended lamp off periods thereby reducing the start up time to reach full lumen output.

SUMMARY OF THE INVENTION

A new and improved apparatus and method is provided for regulating mercury vapor equilibrium and decreasing the start up time to reach full lumen output in fluorescent lamps.

In an exemplary embodiment of the invention, the apparatus employs an envelope housing a container having an opening at one end which is selectively opened during lamp operation and closed during lamp off periods.

In a preferred arrangement, a bimetal member is operatively associated with the opening of the container for adjusting the container between an open position and a closed position. A stopping member such as a valve or ball bearing is actuated by the bimetal member and prevents mercury vapor diffusion during lamp off periods. When the lamp is turned on heat is applied to the bimetal member causing the member to deflect. The deflection of the bimetal member releases the stopping member and opens the container allowing the amalgam to maintain vapor pressure equilibrium. When the lamp is turned off, the decrease in temperature causes the bimetal member to contract thereby closing the container and preventing mercury diffusion. As a result, sufficient mercury vapor remains in the lamp envelope during lamp off periods and prevents lamp starting penalties.

A principal advantage of the invention is provided by the peak lumen output during lamp startup time.

Another advantage of the invention resides in the regulation of mercury vapor pressure equilibrium in fluorescent lamps after lamp ignition.

Still another advantage of the invention is provided by increased mercury vapor within the lamp envelope during lamp off periods.

DETAILED DESCRIPTION OF THE PREFERRED EMBODIMENT

Figure 1:
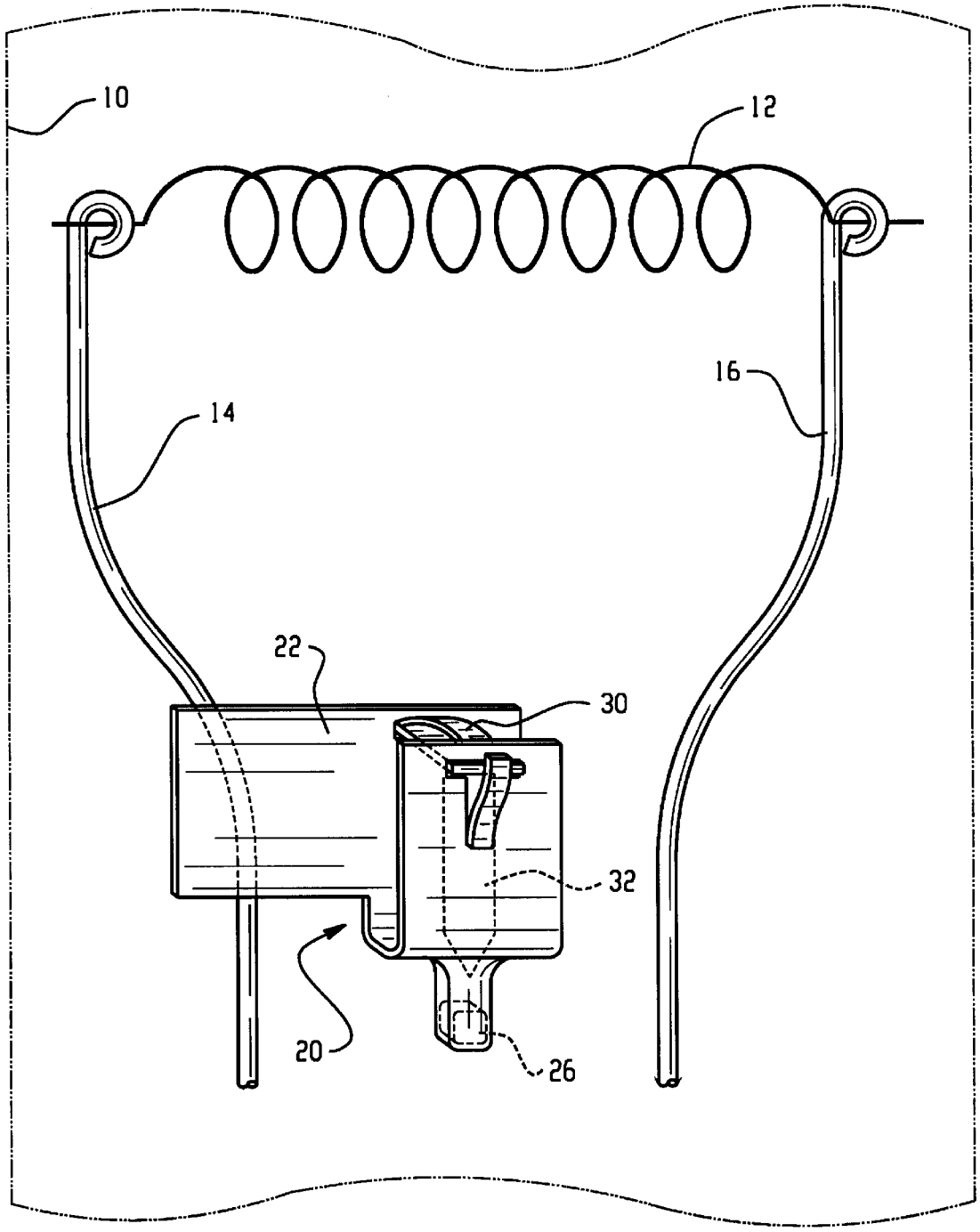
FIG. 1 is an elevational view of selected components within an envelope of a fluorescent lamp in accordance with the present invention.

Referring now to the drawings, which illustrate a preferred embodiment of the invention only and are not intended to limit same, FIG. 1 shows a desired arrangement of components of a lamp envelope disposed in accordance with the present invention. It will be appreciated, however, that other orientations of the components can be obtained in accordance with the teachings of this invention. In a preferred embodiment, a predetermined amount or dose of mercury is disposed within a lamp envelope 10. The envelope encloses a cathode 12 mounted between ends of first and second inner leads 14, 16 in a conventional manner well known to those skilled in the art. A container 20, having a generally cylindrical shape in the exemplary embodiment, is attached to one of the leads 14, 16. Although a weld is a preferred form of securing the container to the lead, it will be understood that other connections can be used without departing from the scope and intent of the present invention. Here, a mounting member, such as strap 22, is secured to the lead 14. The mounting member should not interfere with the lead or cathode so that the arc discharge lamp (a fluorescent lamp) operation is not compromised. It is important, however, and as will become more apparent below, that the mounting member effectively locate the container at a predetermined location adjacent the cathode to advantageously use the heat energy generated thereby.

The container 20 has an opening 24 at one end and houses an amalgam 26. The amalgam 26 comprises a sufficient combination of metals such as lead, bismuth, and tin (Pb, Bi, Sn) and operates to maintain mercury vapor pressure equilibrium during lamp operation. When the lamp is in use, the amalgam maintains equilibrium by replacing the mercury atoms that are spent during operating periods. Particular details of the advantages provided by the amalgam are well known to those skilled in the art so that further discussion herein is deemed unnecessary to a complete understanding of the present invention.

Figure 3:
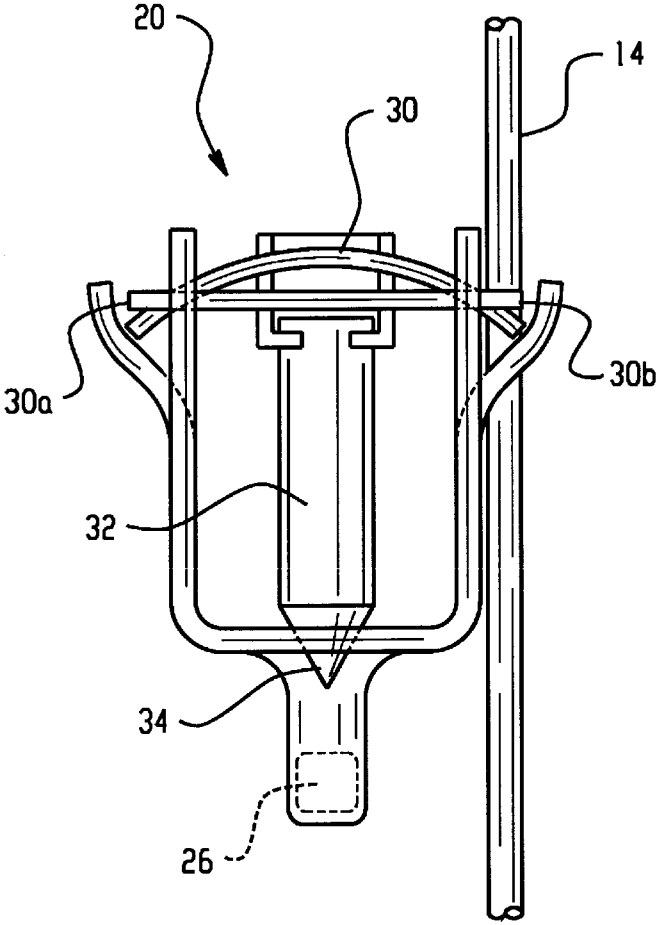
FIG. 3 is a cross-sectional view of the container in accordance with the present invention.
Figure 2:
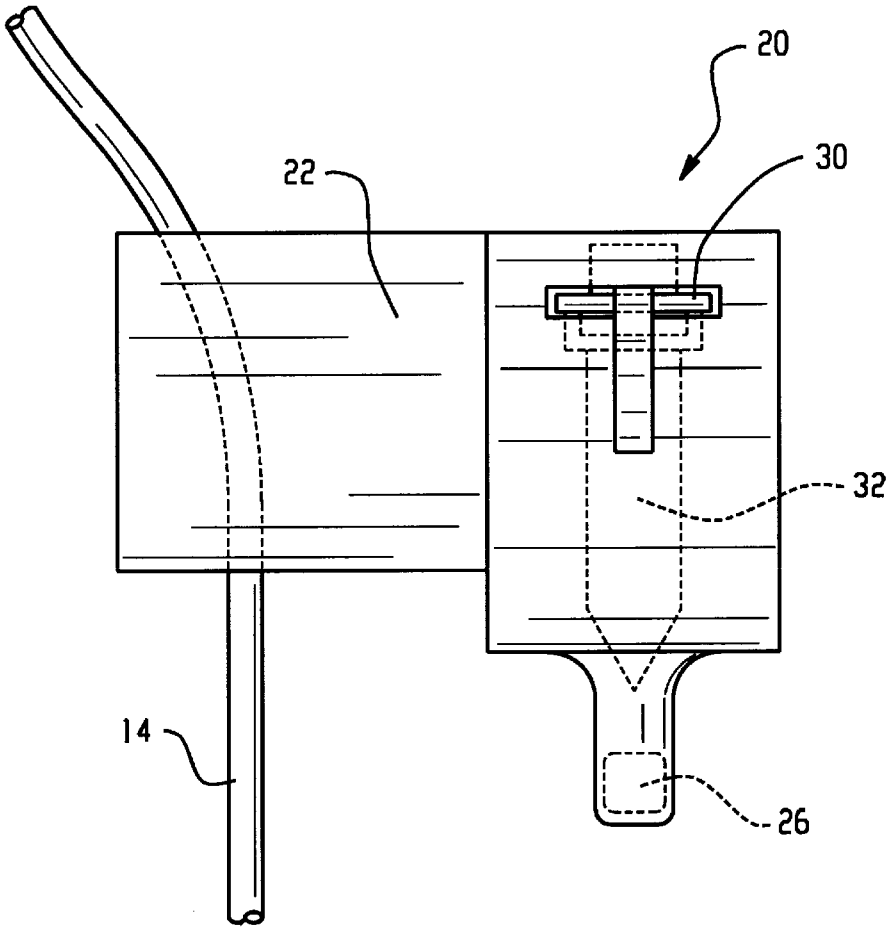
FIG. 2 is an elevational view of a container, housing an amalgam and a valve, secured to an inner lead.
Figure 4:
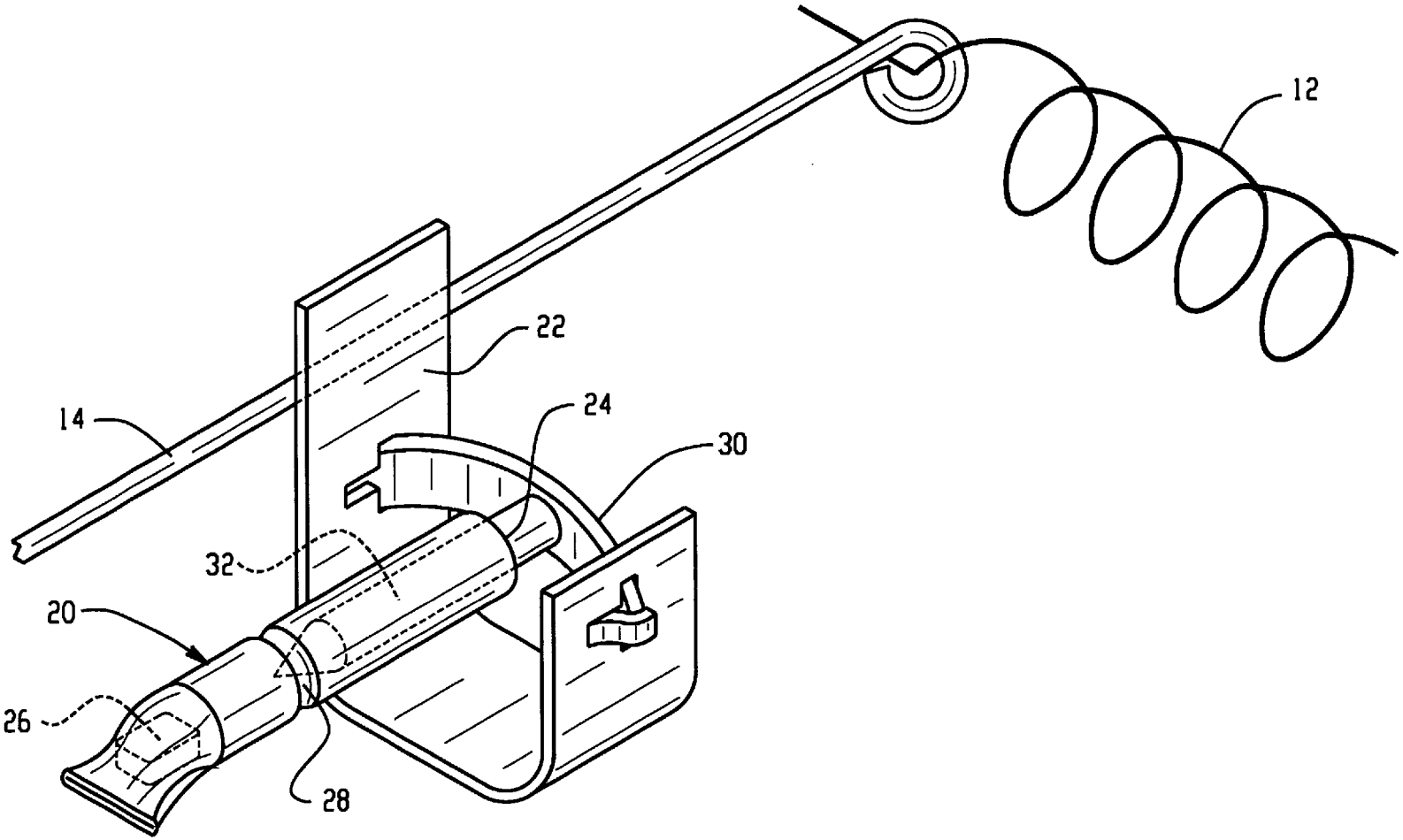
FIG. 4 is a perspective view of a container with an opening, housing an amalgam and a valve, secured to a lead wire.

A bimetal member 30 is associated with the opening 24 of the container 20 and is operatively associated with the opening to selectively allow the container 20 to maintain an open position during lamp operation and a closed position during lamp off periods. The selective opening and closing of the container enables communication between the amalgam 26 and mercury vapor when the lamp is on. A stopping member 32 is preferably attached to the bimetal member and extends into the opening of the container 20 preventing mercury atoms from entering the container during lamp off periods. In this embodiment, the stopping member 32 is preferably a valve with a conical nose 34. Although the stopping member 32 in FIGS. 1–3 comprises a needle valve, it will be appreciated that any other means of preventing mercury vapor from entering the container 20 may be used such as, for example, a ball bearing. The container 20 further includes a rolled groove 28 at a predetermined position along the container 20 which provides a seat for the stopping member 32. The groove provides an easy to manufacture and effective valve seat for the stopping member. It will be appreciated that the seat can be formed in another manner or at a different location in the container as long as it provides a surface against which the stopping member can seal.

The bimetal member has opposite ends 30*a*, 30*b* that are received in openings in the strap. The bimetal member has a slightly bowed contour when cooled (i.e., lamp off condition) that urges the stop member against the seat. When the lamp is energized (i.e., lamp on condition), the bimetal member is further bowed or contoured due to different thermal expansion properties of the two metals forming the bimetal member.

In operation, the cathode 12 receives current from an external power source (not shown) and is heated upon lamp ignition. Since the bimetal member 30 is in relatively close proximity to the cathode 12, the heat from the cathode increases the temperature of the bimetal member. The increase in temperature causes at least one layer of the bimetal member 30 to expand resulting in deflection of the bimetal member. As the bimetal member deflects, the stopping member moves from the seat 28 of the container 20 adjusting the container to an open position.

While in the open position, the amalgam 26 is in direct communication with the mercury vapor disposed within the lamp envelope. As mercury atoms are spent during lamp operation, the amalgam replaces them thereby regulating the mercury vapor pressure equilibrium and providing peak lumen output throughout extended lamp operating periods. When the lamp is turned off, the cathode 12 is deenergized and stops providing heat to the bimetal member, allowing it to cool. The decrease in temperature of the bimetal member causes it to contract, returning the bimetal member 30 to a position adjacent to the opening of the container. Likewise, because the bimetal member is attached to the stopping member, the stopping member 32 engages the seat 28 of the container where it prevents mercury atoms from communicating with the amalgam.

The effect of this apparatus in operation is that when the lamp is turned off the natural diffusion of mercury atoms into the amalgam is prevented. Once the stopping member closes the container, mercury atoms cannot travel back to the amalgam. Therefore, mercury vapor remains in the lamp envelope during lamp off periods and a sufficient dose of mercury vapor disposed within the lamp envelope is available to provide peak lumen output upon lamp ignition. Stated another way, the present invention is adapted to provide the necessary mercury vapor during lamp off periods needed to reach maximum lumen output upon lamp ignition.

Figure 5:
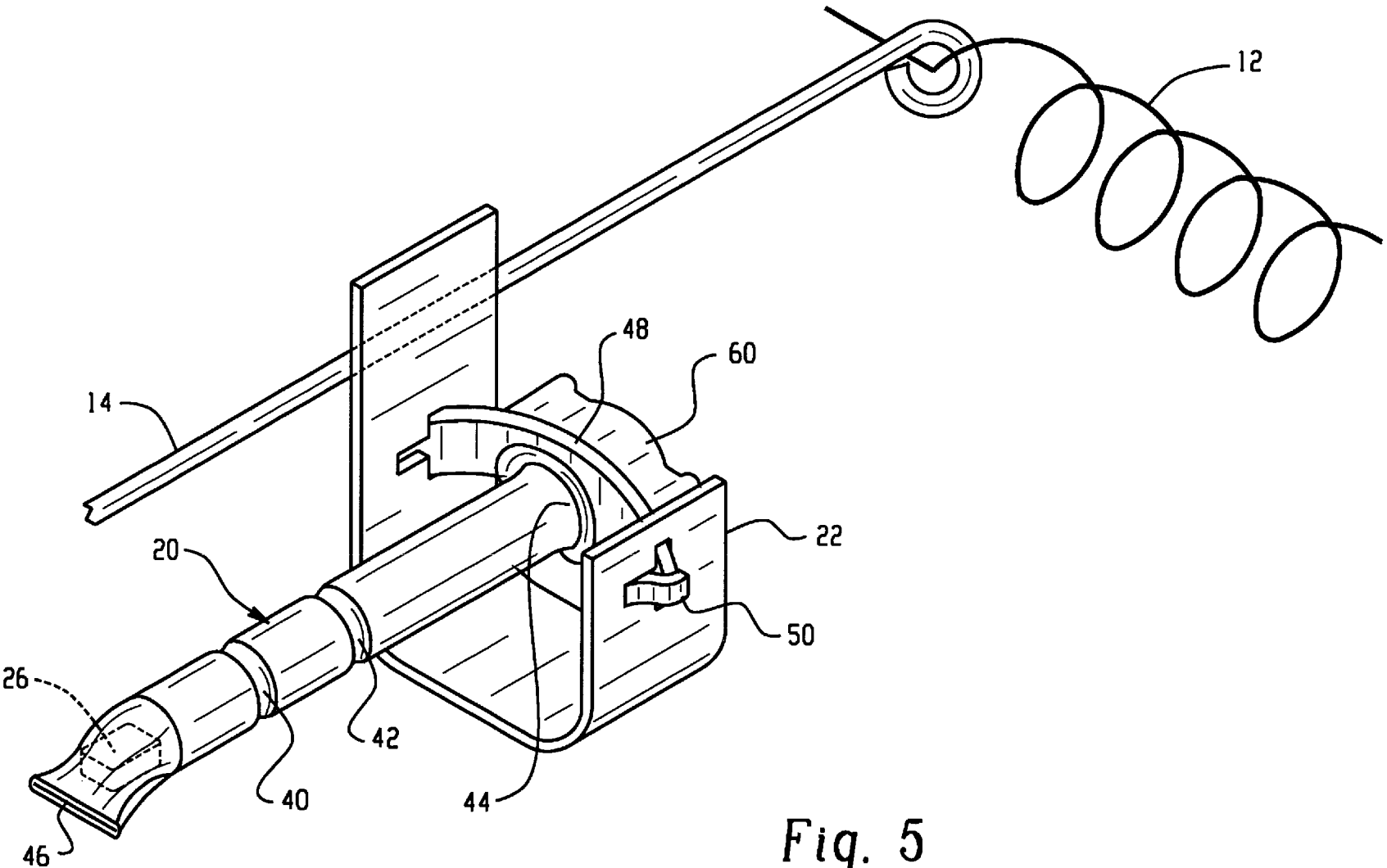
FIG. 5 is a perspective view of another preferred embodiment.
Figure 6:
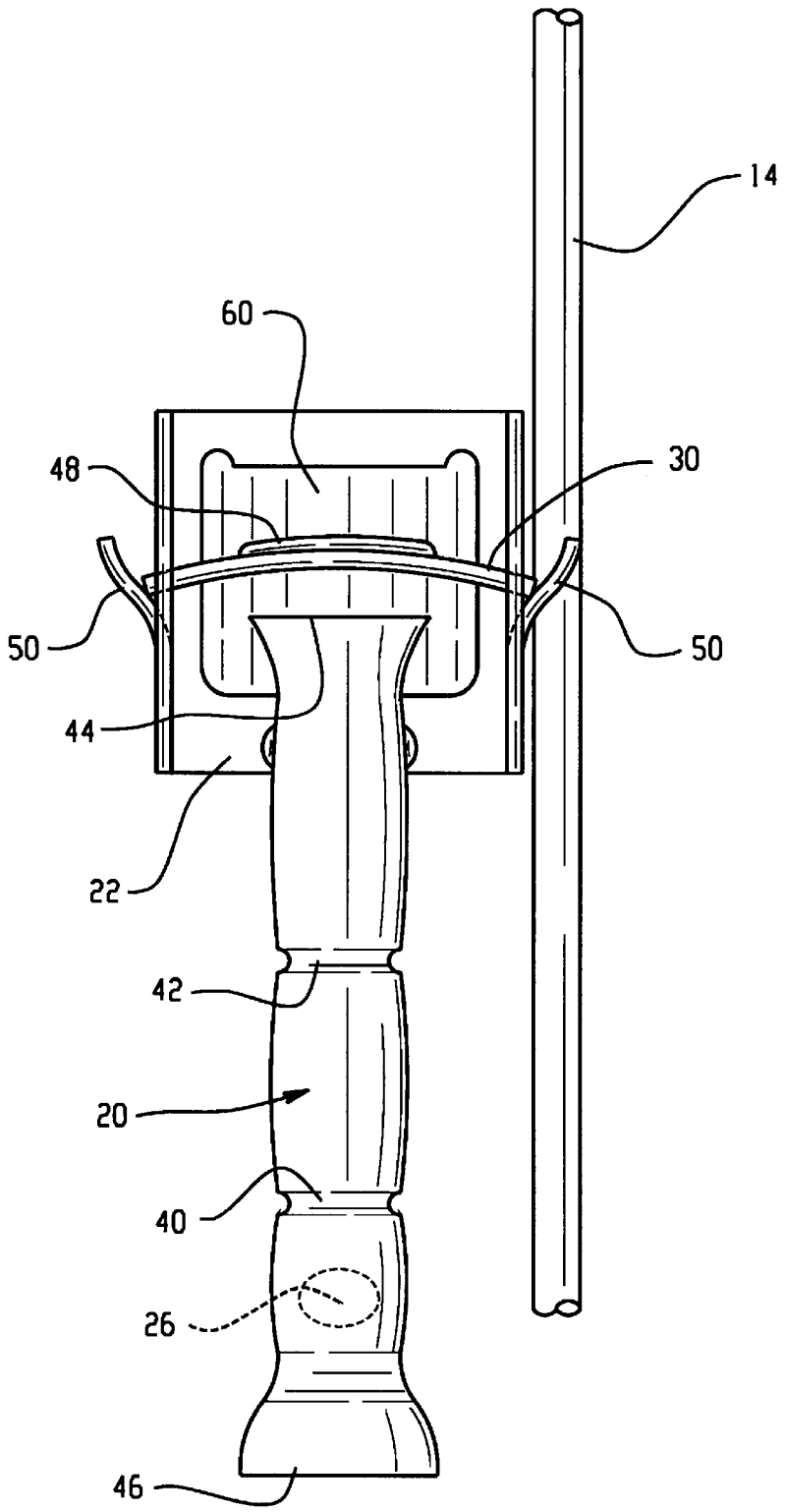
FIG. 6 is a plan view of the embodiment of FIG. 5.

Another preferred embodiment is illustrated in FIGS. 5 and 6. For purposes of brevity and understanding, like reference numerals will refer to like components and new numerals will refer to new components. In this arrangement, the container 20 includes first and second axially spaced grooves 40, 42 that form primary and secondary amalgam holders. End 44 of the container opposite from crimped, closed end 46, is flared to form a seat or seal with the bimetal member 30. The bimetal member includes an integral flared lid 48 that conforms to the flare shape of the container end 44. The bimetal member cooperates with end restraint tabs 50 integrally formed in the mounting member, i.e., stamped from the support frame, to position the lid 48 relative to the container that is welded to the mounting member. The support member is also modified to include an over-deflection member 60 such as an integrally stamped tab extending into the path of movement of the bimetal member to prevent over deflection thereof.

The invention has been described with reference to the preferred embodiment. Obviously, modifications and alterations will occur to others upon a reading and understanding of this specification. For example, a dose of vapor other than mercury may be disposed within the lamp envelope without departing from the principles of this invention. In addition, a different structure for opening and closing the container may be used without departing from the principles of the present invention. Still another alteration would be the use of different materials that cause actuation in response to thermal expansion ro contraction. For example, selected other metals, plastics, fibers, or combinations thereof may prove to be suitable. The invention is intended to include all such modifications and alterations in so far as they come within the scope of the appended claims and the equivalents thereof.

What is claimed is:

1. A discharge lamp comprising:

an envelope;

a dose of vapor disposed within the envelope for increasing the luminescence of the lamp;

at least one container mounted within the envelope having an opening therein selectively adjustable between an open position during lamp operation and a closed position during lamp off periods;

a valve operatively associated with the container opening for selectively preventing mercury vapor diffusion during lamp off periods; and at least one amalgam housed by the container for maintaining mercury vapor pressure equilibrium during lamp operation.

2. A lamp according to claim 1, wherein the container is mounted to a support frame operatively associated with a lead wire disposed in the envelope.

3. A lamp according to claim 1, wherein the container includes a bimetal member associated with the opening of the container for adjusting the container from an open position to a closed position.

4. A lamp according to claim 3, wherein the valve is operatively associated with the bimetal member for selectively preventing mercury vapor diffusion during lamp off periods in response to actuation by the bimetal member.

5. A lamp according to claim 4, wherein the valve includes a nose having a conical configuration.

6. A lamp according to claim 3, wherein the container includes a rolled groove at a predetermined position forming a seat for the valve.

7. A lamp according to claim 3, further including a cathode disposed within the envelope for heating the bimetal material during lamp operation whereby the bimetal material is deflected causing the container to adjust to the open position.

8. A fluorescent lamp comprising:

an envelope;

a dose of mercury vapor disposed within the envelope for increasing the luminescence of the lamp at lamp ignition;

at least one container mounted within the envelope having an opening therein selectively opened during lamp operation and closed during lamp off periods;

a stopping member operatively associated with the container opening for selectively preventing mercury vapor diffusion during lamp off periods;

an amalgam housed in the container for maintaining equilibrium with the mercury vapor pressure during lamp operation; and a thermally responsive member received in the envelope and operatively associated with the stopping member to selectively open and close the container with changes in the temperature.

9. A lamp according to claim 8, wherein the container is mounted to a support frame operatively associated with a lead wire disposed in the envelope.

10. A lamp according to claim 8, wherein the stopping member is a valve having a nose with a conical configuration.

11. A lamp according to claim 8, wherein the container includes a rolled groove forming a seat for the stopping member.

12. A lamp according to claim 8, further including a cathode disposed within the envelope for heating the bimetal material during lamp operation whereby the bimetal material is deflected causing the container to adjust to the open position.

13. A lamp according to claim 8, further comprising a member that is operatively associated with the temperature responsive member to prevent over deflection of the temperature responsive member.

14. A method for regulating mercury vapor pressure equilibrium in a fluorescent lamp having a cathode after lamp ignition comprising the steps of:

mounting a container within an envelope of a fluorescent lamp a predetermined dimension from the cathode;

providing an amalgam within the container;

selectively opening the container during lamp operation; and selectively closing the container during lamp off times for preventing mercury diffusion to the amalgam thereby providing increased mercury vapor in the envelope.

15. The method according to claim 14, wherein the opening step includes:

providing an opening in the container and a stopping member dimensioned to close the opening;

attaching a bimetal material to the stopping member which closes the container during lamp off times; and locating the bimetal material adjacent the cathode to deflect the bimetal material during lamp operation thereby opening the container.

16. The method of claim 14, wherein the process of selectively closing the container includes:

providing an opening adjacent a first end of the container;

attaching a bimetal material to the first end of the container;

connecting a valve to a bottom side of the bimetal material; and sealing the valve tightly in the opening in response to terminating power to the cathode thereby sealing and closing the container.

* * * * *